US006425383B1

(12) United States Patent
Raeske et al.

(10) Patent No.: US 6,425,383 B1
(45) Date of Patent: Jul. 30, 2002

(54) IGNITION COIL WITH CONTROL AND DRIVER APPARATUS HAVING REVERSE POLARITY CAPABILITY

(75) Inventors: Frank John Raeske, Rossford; Carl Richard Blaesing, Toledo, both of OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/610,745

(22) Filed: Jul. 6, 2000

(51) Int. Cl.[7] ..... F02P 3/08
(52) U.S. Cl. ..... 123/643; 123/651
(58) Field of Search ..... 123/640, 643, 123/650–656

(56) References Cited

U.S. PATENT DOCUMENTS

| | | | | |
|---|---|---|---|---|
| 3,910,247 A | | 10/1975 | Hartig | |
| 4,216,755 A | | 8/1980 | Ordines | |
| 4,361,129 A | | 11/1982 | Sugie et al. | |
| 4,378,779 A | | 4/1983 | Hachiga et al. | |
| 4,463,744 A | | 8/1984 | Tanaka et al. | |
| 4,858,586 A | | 8/1989 | Kanno | |
| 5,425,348 A | | 6/1995 | Bracken | |
| 5,503,132 A | | 4/1996 | Miyata et al. | |
| 5,692,484 A | * | 12/1997 | Downey | 123/643 |
| 5,713,338 A | * | 2/1998 | Wheeler | 123/640 |
| 6,189,522 B1 | | 2/2001 | Moriya | 123/643 |

FOREIGN PATENT DOCUMENTS

| | | |
|---|---|---|
| JP | 63-143387 | 6/1988 |
| JP | 03-206355 | 9/1991 |
| JP | 08-277774 | 10/1996 |

* cited by examiner

*Primary Examiner*—Erick Solis
(74) *Attorney, Agent, or Firm*—Reising, Ethington, Barnes, Kisselle, Learman & McCulloch, P.C.

(57) ABSTRACT

An apparatus for a distributorless ignition system which responds to an ignition signal pulse train which is related to the compression and exhaust strokes of an internal combustion engine. The apparatus includes at least one ignition coil having a primary winding, a secondary winding, and a core, wherein the primary winding and the secondary winding are wrapped about the core, and the primary winding has a first end and a second end; a pair of spark plugs for each ignition coil, wherein the spark plugs are connected between opposite ends of the secondary winding and electrical ground; and a circuit connected to the first end and the second end of the primary winding for directing electrical current through the primary winding in an opposite direction during each successive ignition signal pulse such that the spark plugs simultaneously fire after each ignition signal pulse. Preferably, the circuit for directing electrical current through the primary winding includes both a driver circuit and a control circuit. The driver circuit is connected to the primary winding and serves to direct and drive electrical current through the primary winding. The control circuit is connected to the driver circuit and serves to control and activate the driver circuit.

20 Claims, 3 Drawing Sheets

IGNITION COIL WITH CONTROL AND DRIVER APPARATUS HAVING REVERSE POLARITY CAPABILITY

FIELD OF THE INVENTION

The present invention relates to an ignition system for an internal combustion engine. More particularly, the invention relates to a distributorless ignition system suitable for an internal combustion engine such as, for example, an automobile engine.

BACKGROUND OF THE INVENTION

For modem ignition systems associated with internal combustion engines, ways are constantly being sought for extending the useful life of such ignition systems and avoiding the premature necessity of repair and maintenance commonly associated therewith.

One particular way of extending the life of ignition systems has involved the development of an ignition system which does not incorporate a traditional distributor. Such a "distributorless ignition system," sometimes referred to as a "computer-coil ignition system," typically includes, for example, spark plugs, one or more ignition coils, a coil control unit, a computer (such as an engine control module or ECM), and engine sensors. In this type of ignition system, each individual spark plug is functionally associated with an individual cylinder of the engine.

In such a distributorless ignition system, the coil control unit has an electronic circuit for electronically controlling and electrically driving the ignition coil(s). Each individual ignition coil has a primary winding and a secondary winding wrapped about a core. The ends of the primary winding are connected to the coil control unit, and the ends of the secondary winding are wired to two spark plugs. Each spark plug has a center electrode and an outer (or ground) electrode separated by a spark gap. In a "wasted-spark" ignition coil configuration, for example, the center electrodes of the two spark plugs are simply connected to opposite ends of the secondary winding, and the outer electrodes of the two spark plugs are both simply connected to electrical ground. Thus, given that each individual spark plug is associated with an individual cylinder of an engine, a four-cylinder engine having such a distributorless ignition system generally has two ignition coils. A six-cylinder engine, therefore, has three ignition coils.

During operation of the distributorless ignition system, the engine sensors sense engine operating conditions and/or positioning information and pass corresponding data in the form of electrical signals to the engine control module. The engine control module generally interprets this engine data and sends electrical pulses to the coil control unit which dictate ignition timing. Some types of sensed information, however, such as crankshaft position data and/or camshaft position data, may instead be sent directly to the coil control unit without first being interpreted by the engine control module. Once the coil control unit receives ignition timing pulses from the engine control module, the coil control unit then controls and successively drives and applies electrical current through the primary winding of the ignition coil(s). Each time the applied electrical current in the primary winding of an ignition coil is turned off, the magnetic field that was built up in the core of the ignition coil during application then collapses. As a result of the collapse, a brief high-tension current is induced in the secondary winding of the ignition coil. This high-tension current is sufficient to cause simultaneous firing (that is, "arcing" or "sparking") across the individual spark gaps of the two spark plugs which are connected to the secondary winding of the ignition coil. In this way, the simultaneous firing of the two spark plugs is directly related to current engine positioning data and is therefore properly synchronized with the stroke cycle of an internal combustion engine.

A distributorless ignition system as described above has several possible advantages over other types of ignition systems, such as a distributor-based ignition system. These advantages may include one or more of the following: (1) no rotor or distributor cap to burn, crack, or fail; (2) utilization of computer-controlled spark advance ignition timing without the sticking and wearing of mechanical weights; (3) no vacuum advance diaphragm to rupture or leak; (4) any play in timing chain and distributor drive gear is eliminated as a problem that could upset ignition timing; (5) a crankshaft position sensor is not affected by timing chain slack or gear play; (6) there are fewer moving parts to wear and malfunction; and (7) less maintenance is required since ignition timing is typically not adjustable.

In many conventional distributorless ignition systems wherein each ignition coil fires two spark plugs simultaneously in a wasted-spark configuration, successive applications of electrical current are directed and driven in only one direction through the entire length of the primary winding of the ignition coil. Thus, each time the current in the primary winding is turned off, the magnetic field associated with the core of the ignition coil collapses, and the resulting current induced in the secondary winding of the ignition coil always flows in one particular direction. Given that the two spark plugs connected to opposite ends of the secondary winding are connected such that their outer electrodes are both connected to electrical ground, one plug is then always relegated to firing only with a positive polarity while the other plug is always relegated to firing with a negative polarity. See, for example, U.S. Pat. No. 4,216,755 issued to Ordines on Aug. 12, 1980.

Experience has demonstrated, however, that always firing one spark plug with a positive polarity on its center electrode (that is, positive firing) and always firing the other spark plug with a negative polarity on its center electrode (negative firing) is not desirable for purposes of extending the useful life and avoiding the premature necessity for repair and maintenance of an ignition system. In particular, the plug which fires with a positive polarity typically requires a higher firing voltage potential between its two electrodes to successfully "break down" the spark gap (that is, produce arcing) between the electrodes than does the plug firing with a negative polarity. As a result, in a wasted-spark configuration wherein current is successively induced in the secondary winding in the same direction, experience has particularly demonstrated that the center electrode of the always positive firing spark plug exhibits excessive and premature erosion and uneven wearing as compared to the always negative firing spark plug. That is, the useful life of the positive firing spark plug is significantly shorter than the useful life of the negative firing spark plug. Thus, the positive firing spark plug prematurely and undesirably threatens the overall functional integrity of the ignition system.

In an attempt to extend the useful life of the positive firing spark plug in a wasted-spark configuration, some engine manufacturers have specifically reduced the spark gap for only the positive firing spark plug, thereby reducing the firing voltage potential necessary for breaking down the spark gap in the positive firing plug. However, such a remedial attempt generally necessitates an increase in the complexity and cost of engine assembly, for the various cylinders in a given engine will then need to operate with various types of spark plugs with different spark gap settings.

Other engine manufacturers have done away with the traditional wasted-spark configuration and instead attempted to incorporate the two spark plugs for a given ignition coil within a unique diode-based type circuit, which is attached to the secondary winding of the ignition coil, so as to prevent positive firing of the spark plugs. Such diode-based circuits generally permit only one of the two spark plugs to fire during a given high tension pulse in the secondary winding, and the two spark plugs take turns negatively firing during consecutive high tension pulses. In this way, and in contrast to a wasted-spark configuration, the two spark plugs are prevented both from positively firing and from firing simultaneously during the same high tension current pulse in the secondary winding. As a result, the useful lives of both spark plugs are extended. See, for example, U.S. Pat. No. 5,425,348 issued to Bracken on Jun. 20, 1995. However, such a remedial attempt in addition to other non-traditional configurations generally necessitate an increase in the complexity and cost of certain aspects of an ignition system, for such configurations often require the utilization of numerous "steering" or "blocking" diodes, one or more tapped primary windings, or multiple primary windings sharing the same secondary winding. See, for examples, U.S. Pat. No. 4,361,129 issued to Sugie et al on Nov. 30, 1982; U.S. Pat. No. 4,378,779 issued to Hachiga et al on Apr. 5, 1983; and U.S Pat. No. 4,463,744 issued to Tanaka et al on Aug. 7, 1984.

In light of the above, there is a present need in the art for a simple, flexible, and low-cost apparatus which will extend the useful lives of the spark plugs in an ignition system and also thereby extend the useful life of the overall ignition system.

SUMMARY OF INVENTION

The present invention is an ignition coil with control and driver apparatus having reverse polarity capability. The apparatus is suitable for a distributorless ignition system associated with an internal combustion engine. The apparatus responds to an ignition signal pulse train (ISPT) which is related to the compression and exhaust strokes of an internal combustion engine. According to the present invention, the apparatus basically includes, first of all, at least one ignition coil having a primary winding, a secondary winding, and a core. The primary winding and the secondary winding are wrapped about the core, and the primary winding has a first end and a second end. The apparatus also basically includes a pair of spark plugs for each ignition coil. The spark plugs are connected between opposite ends of the secondary winding and electrical ground. Lastly, the apparatus includes a circuit connected to the first end and the second end of the primary winding for directing electrical current through the primary winding in an opposite direction during each successive ignition signal pulse. In this way, the spark plugs simultaneously fire after each ignition signal pulse.

In a preferred embodiment of the apparatus according to the present invention, the circuit for directing electrical current through the primary winding includes both a driver circuit and a control circuit. The driver circuit is connected to the primary winding and serves to direct and drive electrical current through the primary winding. The control circuit is connected to the driver circuit and serves to control and activate the driver circuit. In addition, a capacitor is preferably connected between the first end and the second end of the primary winding of the ignition coil.

The driver circuit is compatible with a direct-current (DC) power supply and preferably includes both an activatable first sub-circuit and an activatable second sub-circuit. The activatable first sub-circuit is capable of electrically connecting the first end of the primary winding to the positive terminal of a direct-current power supply and also electrically connecting the second end of the primary winding to the negative terminal of the power supply. The activatable second sub-circuit is capable of electrically connecting the first end of the primary winding to the negative terminal of the same power supply and also electrically connecting the second end of the primary winding to the positive terminal of the power supply. In such an arrangement, the control circuit serves to altematingly activate the first sub-circuit and the second sub-circuit of the driver circuit in response to an ignition signal pulse train. In this way, the control circuit thereby directs electrical current through the primary winding of the ignition coil in an opposite direction during each successive ignition signal pulse. As a result, the spark plugs simultaneously fire after each ignition signal pulse.

In a highly preferred embodiment of the apparatus according to the present invention, the control circuit includes a J-K flip-flop, a first AND gate, and a second AND gate for controlling and activating the driver circuit. The J-K flip-flop preferably includes a reset input for receiving a pulse when the camshaft of an internal combustion engine reaches top dead center (TDC). In this way, ignition timing, spark timing, and overall synchronization between the apparatus according to the present invention and the stroke cycle of an internal combustion engine is properly maintained and ensured.

Advantages, design considerations, and applications of the present invention will become apparent to those skilled in the art when the detailed description of the best mode contemplated for practicing the invention, as set forth hereinbelow, is read in conjunction with the accompanying drawings.

BRIEF DESCRIPTION OF THE DRAWINGS

The present invention will be described, by way of example, with reference to the following drawings.

DETAILED DESCRIPTION OF THE PREFERRED EMBODIMENT

A detailed description of a preferred embodiment of the present invention is set forth hereinbelow wherein both the structure and the operation of the preferred embodiment are discussed.

1. Structure of the Preferred Embodiment

Figure 1:
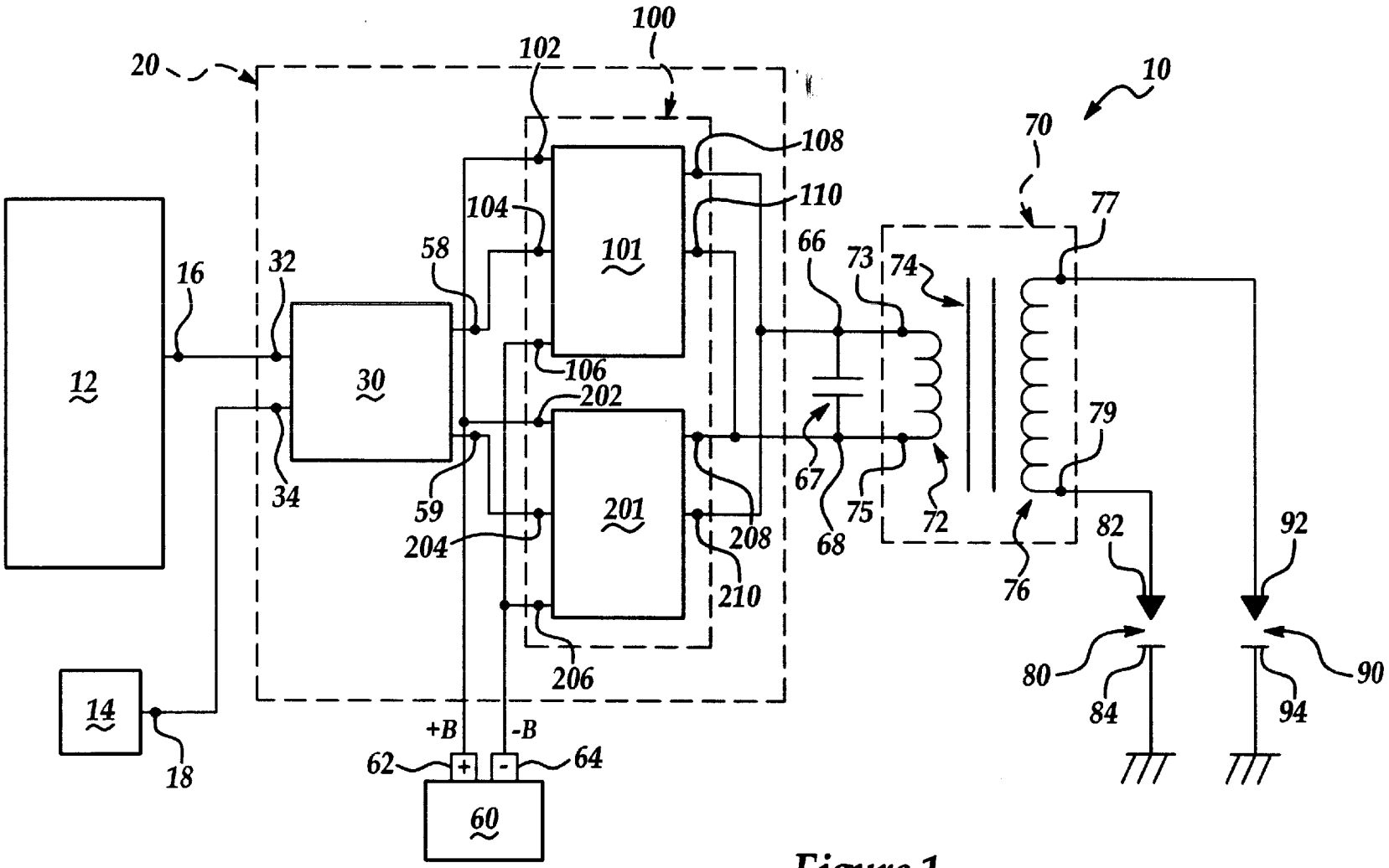
FIG. 1 is a circuit diagram illustrating, according to the present invention, an ignition coil with control and driver apparatus, wherein the diagram particularly highlights a control circuit, a driver circuit, and an ignition coil.

FIG. 1 is a circuit diagram illustrating an ignition coil with control and driver apparatus 10 according to the present invention. The apparatus 10 primarily includes a coil control unit 20 and an ignition coil 70. The coil control unit 20 primarily includes a control circuit 30 and a driver circuit 100. The driver circuit 100 primarily includes a first sub-circuit 101 and a second sub-circuit 201. The driver circuit 100 is connected to the ignition coil 70 and serves to direct and drive electrical current through the ignition coil 70. The control circuit 30 is connected to the driver circuit 100 and serves to control and activate the driver circuit 100.

In FIG. 1, an output node 16 of a computer or an engine control module (ECM) 12 is connected to an input node 32 of the control circuit 30. Although not particularly shown in FIG. 1, it is to be understood that the engine control module 12 may have several data input lines from various different engine sensors concerning the operating conditions of the engine. Such engine sensors may include, for example, a crankshaft position sensor, a camshaft position sensor, a manifold absolute pressure sensor, an intake air temperature sensor, an engine coolant temperature sensor, a knock sensor, a throttle position sensor, et cetera. Furthermore, an output node 18 of a camshaft position sensor 14 is connected to an input node 34 of the control circuit 30. In addition, an output node 58 of the control circuit 30 is connected to an input node 104 of the first sub-circuit 101 of the driver circuit 100, and an output node 59 of the control circuit 30 is connected to an input node 204 of the second sub-circuit 201 of the driver circuit 100.

According to the present invention, the apparatus 10 utilizes a direct-current (DC) battery or power supply 60 having a positive terminal 62 and a negative terminal 64. The positive terminal 62 is connected to an input node 102 of the first sub-circuit 101 and to an input node 202 of the second sub-circuit 201. The negative terminal 64, on the other hand, is connected to an output node 106 of the first sub-circuit 101 and to an output node 206 of the second sub-circuit 201.

Further in FIG. 1, the ignition coil 70 has a primary winding 72 and a secondary winding 76 which are both wrapped about a core 74. The core 74 is preferably a single-form, closed-type core made of iron. The primary winding 72 has a first end 73 and a second end 75. The first end 73 is connected to a node 66, and the second end 75 is connected to a node 68. Between the node 66 and the node 68, a capacitor 67 is connected. In addition, an output node 108 of the first sub-circuit 101 is connected to the node 66 and to an input node 210 of the second sub-circuit 201. An output node 208 of the second sub-circuit 201, however, is connected to the node 68 and to an input node 110 of the first sub-circuit 101.

Lastly in FIG. 1, the secondary winding 76 of the ignition coil 70 has a first end 77 and a second end 79 which are opposite each other. The first end 77 of the secondary winding 70 is connected to a first spark plug 90 having a center electrode 92 and an outer electrode 94. The center electrode 92 is connected to the first end 77, and the outer electrode 94 is connected to electrical ground. Similarly, the second end 79 of the secondary winding 70 is connected to a second spark plug 80 having a center electrode 82 and an outer electrode 84. The center electrode 82 is connected to the second end 79, and the outer electrode 84 is connected to electrical ground.

Figure 2:
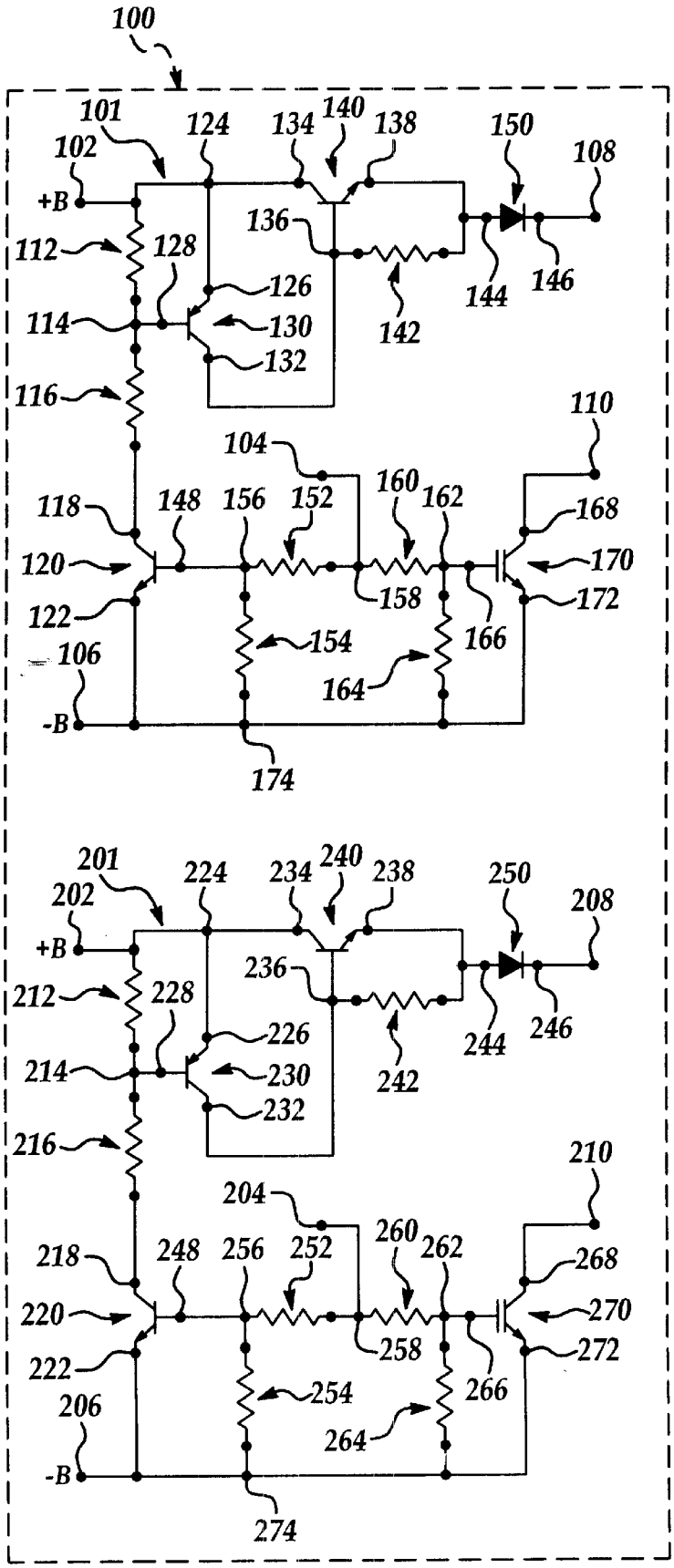
FIG. 2 is a circuit diagram illustrating, according to the present invention, the driver circuit, wherein the diagram particularly highlights both a first sub-circuit and a second sub-circuit of the driver circuit.

FIG. 2 is a circuit diagram illustrating the first sub-circuit 101 and the second sub-circuit 201 of the driver circuit 100. Both the first sub-circuit 101 and the second sub-circuit 201 are identical. Thus, for brevity, only the first sub-circuit 101 is discussed in detail hereinbelow. For convenience, however, like components in the second sub-circuit 201 have numerical designations which share the same last two numerical digits as the corresponding components in the first sub-circuit 101.

In the first sub-circuit 101, a resistor 112 is connected between the input node 102 and a node 114. A node 124 is connected to the input node 102 and to an emitter 126 of a PNP-type bipolar-junction transistor (BJT) 130. A base 128 of the BJT 130 is connected to the node 114, and a collector 132 of the BJT 130 is connected to a base 136 of a NPN-type BJT 140. The BJT 140 has a collector 134 connected to the node 124 and has an emitter 138 connected to an anode 144 of a diode 150. A resistor 142 is connected between the base 136 of the BJT 140 and the anode 144 of the diode 150. In this arrangement, the BJT 140 is able to function as a high-gain, high-current amplifier in an emitter-follower configuration. A cathode 146 of the diode 150 is connected to the output node 108 of the sub-circuit 101.

With further regard to the first sub-circuit 101 in FIG. 2, a resistor 116 is connected between the node 114 and a collector 118 of a NPN-type BJT 120. The BJT 120 has an emitter 122 connected to the output node 106 and has a base 148 connected to a node 156. A resistor 154 is connected between the node 156 and a node 174, and the node 174 is connected to the output node 106. In addition, a resistor 152 is connected between the node 156 and a node 158. The node 158, in turn, is connected to the input node 104. Between the node 158 and a node 162, a resistor 160 is connected, and a resistor 164 is connected between the node 162 and the node 174. Lastly in FIG. 2, a high-speed, high-current BiFET (bi-field effect transistor) 170 has a gate 166 connected to the node 162, a drain 168 connected to the input node 110, and a source 172 connected to the node 174.

Figure 3:
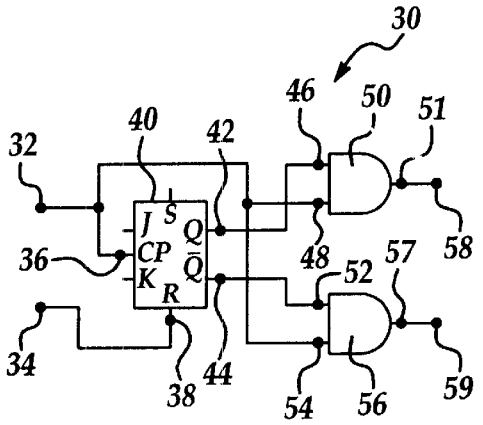
FIG. 3 is a circuit diagram illustrating, according to the present invention, the control circuit.

FIG. 3 is a circuit diagram illustrating the control circuit 30. The control circuit 30 primarily includes a J-K flip-flop 40, a first AND gate 50, and a second AND gate 56. The flip-flop 40 has a clock input 36, a reset input 38, a first output (Q) 42, and a second output (not Q) 44. The first output 42 and the second output 44 of the flip-flop 40 produce electrical signals which are logically opposite from each other.

The first AND gate 50 has a first input 46, a second input 48, and an output 51. The first output 42 of the flip-flop 40 is connected to the first input 46 of the first AND gate 50, and the output 51 of the first AND gate 50 is connected to the output 58 of the control circuit 30. Similarly, the second AND gate 56 has a first input 52, a second input 54, and an output 57. The second output 44 of the flip-flop 40 is connected to the first input 52 of the second AND gate 56, and the output 57 of the second AND gate 56 is connected to the output node 59 of the control circuit 30.

Lastly in FIG. 3, the input node 32 of the control circuit 30 is connected to the clock input 36 of the flip-flop 40, the second input 48 of the first AND gate 50, and the second input 54 of the second AND gate 56. The input 34 of the control circuit 30 is connected to the reset input 38 of the flip-flop 40.

This concludes the detailed description of the structure of the preferred embodiment according to the present invention.

2. Operation of the Preferred Embodiment

Figure 5:
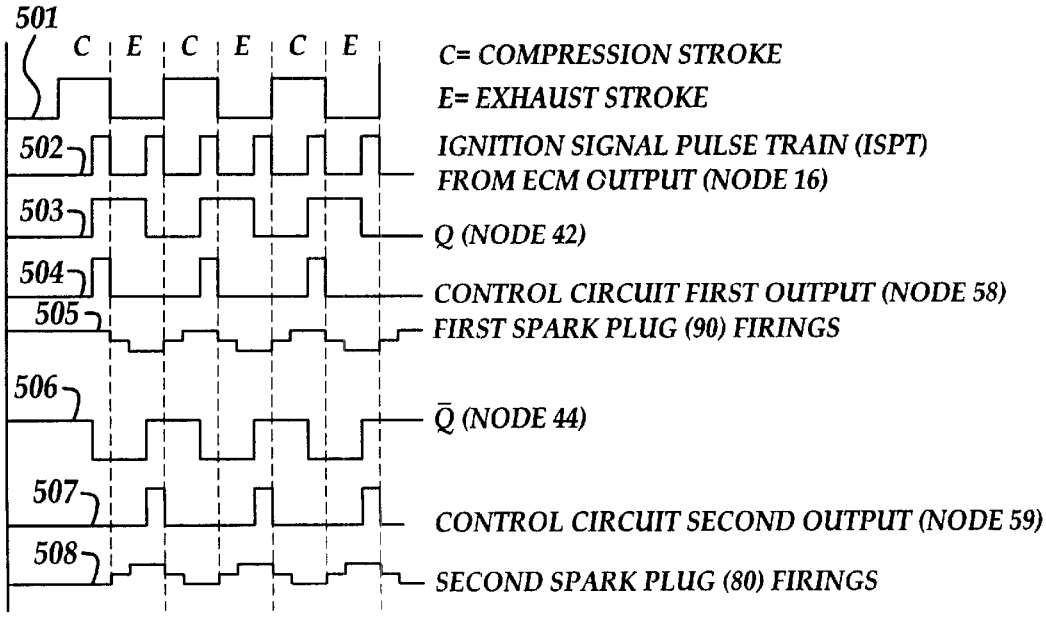
FIG. 5 is a signal timing chart illustrating, in contrast to FIG. 4 and according to the present invention, how two spark plugs associated with the same ignition coil in an ignition system incorporating the present invention fire with different and alternating firing polarities.

FIG. 5 is a signal timing chart wherein an ignition signal pulse train (ISPT) 502 is synchronized with the compression strokes (C) and exhaust strokes (E), represented by a waveform 501, of the cycle of an internal combustion engine. The ISPT 502 is generated by the engine control module (ECM) 12 in accordance to engine operating conditions and/or positioning information which is received by the ECM 12 from various engine sensors. In general, the ISPT 502 is a carefully timed triggering signal which ultimately serves to fire both the first spark plug 90 and the second spark plug 80 in sync with the compression strokes and the exhaust strokes of an engine cycle. Once the ISPT 502 is generated, the ISPT 502 is transmitted via the output node 16 of the ECM 30 to the input node 32 of the control circuit 30 of the coil control unit 20.

In general, the coil control unit 20 serves to control the operation of the ignition coil 70 and, thus, the firing of both the first spark plug 90 and the second spark plug 80 as dictated by the ISPT 502 generated by the ECM 30. The driver circuit 100 of the coil control unit 20 directs and drives electric current through the primary winding 72 of the ignition coil 70, and the control circuit 30 controls both the activation and mode of operation of the driver circuit 100. Whenever the driver circuit 100 is activated by the control circuit 30, the first sub-circuit 101 and the second sub-circuit 201 of the driver circuit 100 operate in a mutually exclusive fashion from each other and control the direction and polarity of the current that is driven through the primary winding 72 of the ignition coil 70. More particularly, when the first sub-circuit 101 of the driver circuit 100 is selectively activated by the control circuit 30, a current is driven from the first end 73 to the second end 75 of the primary winding 72. In the alternative, when the second sub-circuit 201 of the driver circuit 100 is selectively activated by the control circuit 30, a current is driven from the second end 75 to the first end 73 of the primary winding 72. In this way, once the current through the primary winding 72 is turned off by the driver circuit 100 and the magnetic field in the core 74 thereafter collapses, the first spark plug 90 and the second spark plug 80 then simultaneously fire with opposite firing polarities. The specific firing polarity for each of the first spark plug 90 and the second spark plug 80 depends upon the direction and polarity of the current directed through the primary winding 72 by the driver circuit 100 just before the collapse of the magnetic field.

Referring to FIG. 3, when the control circuit 30 receives the ISPT 502 at the input node 32, the ISPT 502 is received by the flip-flop 40 at the clock input 36. As a result, the flip-flop produces an output signal (Q) 503 at the first output 42 and also produces an output signal (not Q) 506 at the second output 44. Waveforms for both the output signal 503 and the output signal 506 are illustrated in FIG. 5. Furthermore, the output signal 503 is received at the first input 46 of the first AND gate 50, and the output signal 506 is received at the first input 52 of the second AND gate 56. Thus, when the ISPT 502 is received at the second input 48 of the first AND gate 50 and at the second input 54 of the second AND gate 56, an output signal 504 is produced at the output 51 of the first AND gate 50, and an output signal 507 is produced at the output 57 of the second AND gate 56. Waveforms for both the output signal 504 and the output signal 507 are illustrated in FIG. 5. The output signal 504 is then transmitted to the output node 58 of the control circuit 30 and ultimately to the input node 104 for activating the first sub-circuit 101 of the driver circuit 100. Similarly, the output signal 507 is then transmitted to the output node 59 of the control circuit 30 and ultimately to the input node 204 for activating the second sub-circuit 201 of the driver circuit 100.

At this point, it is important to note that the positive pulses in the output signal 504 and the positive pulses in the output signal 507, as illustrated in FIG. 5, are staggered and alternate with each other. As a result, when the apparatus 10 is operating properly, the first sub-circuit 101 and the second sub-circuit 201 of the driver circuit 100 are never activated at the same time. Instead, the first sub-circuit 101 and the second sub-circuit 201 are activated at times which alternate with each other, interspersed with brief time periods wherein neither the first sub-circuit 101 nor the second sub-circuit 201 is activated. These brief time periods when neither sub-circuit is activated permit the magnetic field in the core 74 of the ignition coil 70 to collapse immediately after a current has been applied and turned off in the primary winding 72 by one of the sub-circuits. In this way, the first spark plug 90 and the second spark plug 80 immediately and simultaneously fire each time one of the sub-circuits is deactivated.

Referring to FIG. 2, operations of the first sub-circuit 101 and the second sub-circuit 201 of the driver circuit 100 are as follows. When a high positive pulse of the signal 504 is received at the input node 104 of the first circuit 101, the first sub-circuit 101 essentially electrically connects the positive terminal (+B) 62 of the power supply 60 to the output node 108 of the first sub-circuit 101 via the input node 102. At the same time, the negative terminal (−B) 64 of the power supply 60 is essentially connected to the input node 110 of the first sub-circuit 101 via the output node 106. As a result, power and current derived from the power supply 60 is directed through the output node 108 of the first sub-circuit 101, through the node 66, through the first end 73 of the primary winding 72, down through the length of the primary winding 72, through the second end 75 of the primary winding 72, through the node 68, and into the input node 110 of the first sub-circuit 101. Similarly, when a positive pulse of the signal 507 is received at the input node 204 of the second sub-circuit 201, the second sub-circuit 201 essentially electrically connects the positive terminal (+B) 62 of the power supply 60 to the output node 208 of the second sub-circuit 201 via the input node 202. At the same time, the negative terminal (−B) 64 of the power supply 60 is essentially connected to the input node 210 of the second sub-circuit 201 via the output node 206. As a result, power and current derived from the power supply 60 is directed through the output node 208 of the second sub-circuit 201, through the node 68, through the second end 75 of the primary winding 72, up through the length of the primary winding 72, through the first end 73 of the primary winding 72, through the node 66, and into the input node 210 of the second sub-circuit 201.

With more particular regard to the operation of the sub-circuit 101, the sub-circuit 101 is only activated when a high positive pulse of the signal 504 is received at the input node 104. When the positive pulse is received, signals at the gate 166 of the BiFET 170 and at the base 148 of the BJT 120 both go high. As a result, current from the drain 168 to the source 172 of the BiFET 270 is permitted to pass, thereby electrically connecting the input node 110 to the output node 106. In this way, the second end 75 of the primary winding 72 is electrically connected to the negative terminal 64 of the power supply 60 via the node 68, the input node 110, and the output node 106. As the signal at the base 148 of the BJT 120 goes high, current is then permitted to pass from the collector 118 to the emitter 122 of the BJT 120. As a direct result, current is able to flow from the base 128 of the PNP-type BJT 130, thereby permitting current to pass from the emitter 126 to the collector 132 of the BJT 130 as supplied by the positive terminal 62 of the power supply 60 which is connected to the input node 102 of the first sub-circuit 101.

With further regard to the operation of the sub-circuit 101, when current passes from the emitter 126 to the collector 132 of the BJT 130, a signal at the base 136 of the BJT 140 goes high. As a result, current is thereby permitted to pass from the collector 134 to the emitter 138 of the BJT 140 as supplied by the positive terminal 62 of the power supply 60 which is connected to the input node 102. When this occurs, the diode 150 becomes forward biased, thereby permitting current to pass from the positive terminal 62 of the power supply 60, through the input node 102, through the output node 108, through the node 66, and into the first end 73 of the primary winding 72 of the ignition coil 70. In this way, the first end 73 of the primary winding 72 is electrically connect ed to the positive terminal 62 of the power supply 60.

When, however, the signal 504 is low at the input node 104 of the first sub-circuit 101, the BJT 120 and the BiFET 170 are no longer biased into conduction and are thereby deactivated. As a direct result of the BiFET 170 being deactivated, the negative terminal 64 of the power supply 60 is no longer electrically connected to the second end 75 of the primary winding 72 of the ignition coil 70. Furthermore, as a result of the BJT 120 being deactivated, current is no longer permitted to flow from the base 128 of the PNP-type BJT 130. Thus, when the BJT 120 is deactivated, the BJT 130 is no longer biased into conduction and is thereby deactivated as well. When this occurs, the signal at the base 136 of the BJT 140 is made low since current cannot pass through the BJT 130 which is deactivated. Thus, the BJT 140 is no longer biased into conduction and is thereby deactivated as well. As a direct result of the BJT 140 being deactivated, the positive terminal 62 of the power supply 60 is no longer electrically connected to the first end 73 of the primary winding 72 of the ignition coil 70.

Basic operation of the second sub-circuit 201 is generally the same as the operation of the first sub-circuit. However, whereas the first sub-circuit 101 electrically connects the positive terminal 62 of the power supply 60 to the first end 73 of the primary winding 72 and electrically connects the negative terminal 64 of the power supply 60 to the second end 75 of the primary winding 72 when a high positive pulse of the signal 504 is received at the input node 104, the second sub-circuit 201 electrically connects the positive terminal 62 of the power supply 60 to the second end 75 of the primary winding 72 and electrically connects the negative terminal 64 of the power supply 60 to the first end 73 of the primary winding 72 when a high positive pulse of the signal 507 is received at the input node 204. As FIG. 5 illustrates, the first sub-circuit 101 and the second sub-circuit 201 are in activation states at different times. In particular, the first sub-circuit 101 is activated during the compression stroke of an engine cycle by the signal 504. The second sub-circuit 201, in contrast, is activated during the exhaust stroke of an engine cycle by the signal 507.

Referring back to FIG. 1, basic operation of the ignition coil 70, the first spark plug 90, and the second spark plug 80 is as follows. When the first sub-circuit 101 of the driver circuit 100 is activated, the first end 73 of the primary winding 72 is electrically connected to the positive terminal 62 of the power supply 60. In addition, the second end 75 of the primary winding 72 is electrically connected to the negative terminal 64 of the power supply 60. When such occurs, a positive voltage potential is transferred to the first end 73 of the primary winding 72, and a negative voltage potential is transferred to the second end 75 of the primary winding 72. A current then passes through the primary winding 72 from the first end 73 to the second end 75. The current passing through the primary winding 72 produces a magnetic field in the core 74 of the ignition coil 70. The magnetic field then induces a voltage drop across the length of the secondary winding 76 such that the first end 77 of the secondary winding 76 has a positive voltage potential and the second end 79 of the secondary winding 76 has a negative voltage potential. When the first sub-circuit 101 is suddenly deactivated when the signal 504 goes low, the positive terminal 62 and the negative terminal 64 of the power supply 60 are suddenly electrically disconnected from the first end 73 and the second end 75 of the primary winding 72. As a result, the magnetic field in the core 74 of the ignition coil 70 suddenly collapses and thereby causes current flow in the primary winding 72 which is eventually dissipated by the capacitor 67. Such a sudden collapse also induces a high-tension voltage drop across the length of the secondary winding 76 with a reversed polarity. That is, the voltage potential of the first end 77 of the secondary winding 76 is suddenly changed from positive to negative while the voltage potential of the second end 79 of the secondary winding 76 is suddenly changed from negative to positive. Such produces a high-level current in the secondary circuit which simultaneously fires both the first spark plug 90 and the second spark plug 80. In this instance, the first spark plug 90 is negatively fired as current arcs from the outer electrode 94 to the center electrode 92 (which has a negative voltage potential). The second spark plug 80, however, is positively fired as current arcs from the center electrode 82 (which has a positive voltage potential) to the outer electrode 84. Referring to FIG. 5, the spikes in signal 505 correspond to the firings of the first spark plug 90, and the spikes in signal 508 correspond to the firings of the second spark plug 80.

Alternatively, when the second sub-circuit 201 of the driver circuit 100 is activated, the first end 73 of the primary winding 72 is electrically connected to the negative terminal 64 of the power supply 60, and the second end 75 of the primary winding 72 is electrically connected to the positive terminal 62 of the power supply 60. When such occurs, a positive voltage potential is transferred to the second end 75 of the primary winding 72, and a negative voltage potential is transferred to the first end 73 of the primary winding 72. A current then passes through the primary winding 72 from the second end 75 to the first end 73. The current passing through the primary winding 72 again produces a magnetic field in the core 74 of the ignition coil 70. The magnetic field then induces a voltage drop across the length of the secondary winding 76 such that the first end 77 of the secondary winding 76 has a negative voltage potential and the second end 79 of the secondary winding 76 has a positive voltage potential. When the second sub-circuit 201 is suddenly deactivated when the signal 507 goes low, the positive terminal 62 and the negative terminal 64 of the power supply 60 are suddenly electrically disconnected from the second end 75 and the first end 73 of the primary winding 72. As a result, the magnetic field in the core 74 of the ignition coil 70 suddenly collapses and thereby causes current flow in the primary winding 72 which is eventually dissipated by the capacitor 67. Such a sudden collapse also induces a high-tension voltage drop across the length of the secondary winding 76 with a reversed polarity. That is, the voltage potential of the first end 77 of the secondary winding 76 is suddenly changed from negative to positive while the voltage potential of the second end 79 of the secondary winding 76 is suddenly changed from positive to negative. Such produces a high-level current in the secondary circuit which simultaneously fires both the first spark plug 90 and the second spark plug 80. In this instance, the first spark plug 90 is positively fired as current arcs from the center electrode 92 (which has a positive voltage potential) to the outer electrode 94. The second spark plug 80, however, is negatively fired as current arcs from the outer electrode 84 to the center electrode 82 (which has a negative voltage potential).

At this point, it is important to note that the diode 150 of the first sub-circuit 101 and the diode 250 of the second sub-circuit both serve two important functions. First, when the magnetic field in the core 74 of the ignition diode 70 collapses due to the terminals 62 and 64 of the power supply 60 being electrically disconnected from the ends 73 and 75 of the primary winding 72, the diode 150 electrically protects (that is, electrically isolates) the emitter 138 of the BJT 140 and the diode 250 electrically protects the emitter 238 of the BJT 240 from electrical damage which may result from high-voltage spikes caused by the collapse of the magnetic field. Second, the diode 150 of the first sub-circuit 101 electrically protects the emitter node 138 of the BJT 140 from the electrical activity of the second sub-circuit 201 during times when the second sub-circuit 201 is activated. Likewise, the diode 250 of the second sub-circuit 201 electrically protects the emitter node 238 of the BJT 240 from the electrical activity of the first sub-circuit 101 during times when the first sub-circuit 101 is activated.

Referring briefly to FIG. 1 and to FIG. 3, during operation of the present invention, there exists the remote possibility that the output signal (Q) 503 at the first output 42 and the output signal (not Q) 506 at the second output 44 of the flip-flop 40 become out of sync with each other and/or the ISPT 502. In such a case, the ignition coil 70 may then undesirably produce positive firings for both cylinders associated with the first spark plug 90 and the first spark plug 80. To prevent this from happening, the flip-flop 40 receives a pulse at the reset input 38 from the output node 18 of the camshaft position sensor 14 when the engine camshaft reaches top dead center (TDC).

Figure 4:
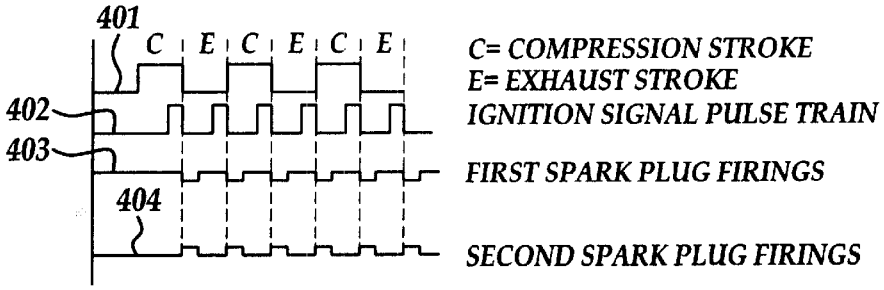
Figure 4 Prior Art
FIG. 4 is a signal timing chart illustrating, according to the prior art, how one spark plug is always relegated to positive firing and the other spark plug is always relegated to negative firing in a conventional ignition system having a wasted-spark configuration.

FIG. 4 is a signal timing chart illustrating, according to the prior art, how one spark plug is always relegated to positive firing and the other spark plug is always relegated to negative firing in a conventional ignition system having a wasted-spark configuration. More particularly, FIG. 4 is a signal timing chart, according to the prior art, wherein an ignition signal pulse train (ISPT) 402 is synchronized with the compression strokes (C) and exhaust strokes (E), represented by a waveform 401, of the cycle of an internal combustion engine. The ISPT 402 is generated by a computer or engine control module (ECM) in accordance to engine operating conditions and/or positioning information which is received by the ECM from various engine sensors. The ISPT 402 is a carefully timed triggering signal which ultimately serves to fire two spark plugs in sync with the compression strokes and the exhaust strokes of an engine cycle. As FIG. 4 illustrates, in a conventional ignition system having a wasted-spark configuration, often one spark plug is relegated to only negative firings (signal 403), and the other spark plug is relegated to only positive firings (signal 404). In such a conventional ignition system, the spark plug which is relegated to only positive firings will have a useful life which is significantly shorter than the useful life of the negative firing spark plug. Thus, the positive firing spark plug will prematurely and undesirably threaten the overall functional integrity of the ignition system.

In contrast to such a conventional ignition system, an advantage of utilizing the apparatus 10 according to the present invention is that the device 10 ensures that a spark plug is never relegated to only positive firings. Instead, as illustrated by the signal 505 and the signal 508 in FIG. 5, the present invention ensures that positive and negative firings are equally distributed among the two spark plugs in a given spark plug pair. In this way, the useful life of the spark plugs as a pair is thereby extended, and the overall functional integrity of the ignition system is thereby extended as well. Another advantage of the apparatus 10 according to the present invention is that it does not necessitate the utilization of numerous steering or blocking diodes, tapped primary windings, spark plugs with various gap sizes, et cetera. As a result, the apparatus 10 according to the present invention is comparatively low-cost and can be flexibly incorporated within the overall design of a given ignition system. Other advantages, design considerations, and applications of the present invention will become apparent to those skilled in the art when the detailed description of the best mode contemplated for practicing the invention, as is set forth hereinabove, is read in conjunction with the drawings.

This concludes the detailed description of the operation of the preferred embodiment according to the present invention.

While the present invention has been described in what is presently considered to be the most practical and preferred embodiment and/or implementation of the invention, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground; and a circuit connected to said first end and said second end of said primary winding for directing electrical current through said primary winding in an opposite direction during each successive ignition signal pulse such that said spark plugs simultaneously fire after each ignition signal pulse.

2. The apparatus according to claim 1, wherein said core is a closed-type core comprising iron.

3. The apparatus according to claim 1, wherein each of said spark plugs has a center electrode and an outer electrode, wherein said center electrode is electrically connected to said secondary winding, and said outer electrode is electrically connected to electrical ground.

4. The apparatus according to claim 1, wherein said circuit comprises:

a driver circuit connected to said primary winding for directing electrical current through said primary winding; and a control circuit connected to said driver circuit for activating said driver circuit.

5. The apparatus according to claim 4, wherein said driver circuit comprises:

an activatable first sub-circuit capable of selectively providing an electrical connection between said first end of said primary winding and a positive terminal of a direct-current power supply and capable of selectively providing an electrical connect ion bet ween said second end of said primary winding and a negative terminal of said power supply; and an activatable second sub-circuit capable of selectively providing an electrical connection between said first end of said primary winding and said negative terminal of said power supply and capable of selectively providing an electrical connection between said second end of said primary winding and s aid positive terminal of said power supply.

6. The apparatus according to claim 5, wherein said control circuit has means for altematingly activating said first sub-circuit and said second sub-circuit of said driver circuit in response to an ignition signal pulse train, thereby directing electrical current through said primary winding in an opposite direction during each successive ignition signal pulse such that said spark plugs simultaneously fire after each ignition signal pulse.

7. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

a circuit connected to said first end and said second end of said primary winding for directing electrical current through said primary winding in an opposite direction during each successive ignition signal pulse such that said spark plugs simultaneously fire after each ignition signal pulse; and a capacitor electrically connected between said first end and said second end of said primary winding of said ignition coil.

8. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

a circuit connected to said first end and said second end of said primary winding for directing electrical current through said primary winding in an opposite direction during each successive ignition signal pulse such that said spark plugs simultaneously fire after each ignition signal pulse; and wherein said circuit comprises:

a driver circuit connected to said primary winding for directing electrical current through said primary winding; and a control circuit connected to said driver circuit for activating said driver circuit;

wherein said driver circuit comprises:

an activatable first sub-circuit capable of selectively providing an electrical connection between said first end of said primary winding and a positive terminal of a direct-current power supply and capable of selectively providing an electrical connection between said second end of said primary winding and a negative terminal of said power supply; and an activatable second sub-circuit capable of selectively providing an electrical connection between said first end of said primary winding and said negative terminal of said power supply and capable of selectively providing an electrical connection between said second end of said primary winding and said positive terminal of said power supply;

wherein said control circuit has means for alternatingly activating said first sub-circuit and said second sub-circuit of said driver circuit in response to an ignition signal pulse train, thereby directing electrical current through said primary winding in an opposite direction during each successive ignition signal pulse such that said spark plugs simultaneously fire after each ignition signal pulse;

wherein said activating means of said control circuit comprises:

a J-K flip-flop having a clock input, a first output, and a second output, wherein said first output and said second output produce logically opposite electrical signals;

a first AND gate having a first input, a second input, and one output, wherein said first output of said flip-flop is electrically connected to said first input of said first AND gate, and said one output of said first AND gate is electrically connected to said first sub-circuit of said driver circuit; and a second AND gate having a first input, a second input, and one output, wherein said second output of said flip-flop is electrically connected to said first input of said second AND gate, and said one output of said second AND gate is electrically connected to said second sub-circuit of said driver circuit; and wherein said clock input of said flip-flop, said second input of said first AND gate, and said second input of said second AND gate are electrically connected to receive the ignition signal pulse train.

9. The apparatus according to claim 8, wherein said J-K flip-flop has a reset input for receiving a pulse when the camshaft of an internal combustion engine reaches top dead center.

10. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground; and means connected to said first end and said second end of said primary winding for directing electrical current through said primary winding in an opposite direction during each successive ignition signal pulse such that said spark plugs simultaneously fire after each ignition signal pulse.

11. The apparatus according to claim 10, wherein said core is a closed-type core comprising iron.

12. The apparatus according to claim 10, wherein each of said spark plugs has a center electrode and an outer electrode, wherein said center electrode is electrically connected to said secondary winding, and said outer electrode is electrically connected to electrical ground.

13. The apparatus according to claim 10, wherein said current directing means comprises:

a driver circuit connected to said primary winding for directing electrical current through said primary winding; and control means connected to said driver circuit for activating said driver circuit.

14. The apparatus according to claim 13, wherein said driver circuit comprises:

activatable first means for selectively providing an electrical connection between said first end of said primary winding and a positive terminal of a direct-current power supply and selectively providing an electrical connection between said second end of said primary winding and a negative terminal of said power supply; and activatable second means for selectively providing an electrical connection between said first end of said primary winding and said negative terminal of said power supply and selectively providing an electrical connection between said second end of said primary winding and said positive terminal of said power supply.

15. The apparatus according to claim 14, wherein said control means has means for altematingly activating said first sub-circuit and said second sub-circuit of said driver circuit in response to an ignition signal pulse train, thereby directing electrical current through said primary winding in an opposite direction during each successive ignition signal pulse such that said spark plugs simultaneously fire after each ignition signal pulse.

16. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

means connected to said first end and said second end of said primary winding for directing electrical current through said primary winding in an opposite direction during each successive ignition signal pulse such that said spark plugs simultaneously fire after each ignition signal pulse; and a capacitor electrically connected between said first end and said second end of said, primary winding of said ignition coil.

17. An apparatus for a distributorless ignition system which responds to an ignition signal pulse train of an internal combustion engine, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

means connected to said first end and said second end of said primary winding for directing electrical current through said primary winding in an opposite direction during each successive ignition signal pulse such that said spark plugs simultaneously fire after each ignition signal pulse; and wherein said current directing means comprises:

a driver circuit connected to said primary winding for directing electrical current through said primary winding; and control means connected to said driver circuit for activating said driver circuit;

wherein said driver circuit comprises:

activatable first means for selectively providing an electrical connection between said first end of said primary winding and a positive terminal of a direct-current power supply and selectively providing an electrical connection between said second end of said primary winding and a negative terminal of said power supply; and activatable second means for selectively providing an electrical connection between said first end of said primary winding and said negative terminal of said power supply and selectively providing an electrical connection between said second end of said primary winding and said positive terminal of said power supply;

wherein said control means has means for alternatingly activating said first sub-circuit and said second sub-circuit of said driver circuit in response to an ignition signal pulse train, thereby directing electrical current through said primary winding in an opposite direction during each successive ignition signal pulse such that said spark plugs simultaneously fire after each ignition signal pulse; and wherein said control means comprises:

a J-K flip-flop having a clock input, a first output, and a second output, wherein said first output and said second output produce logically opposite electrical signals;

a first AND gate having a first input, a second input, and one output, wherein said first output of said flip-flop is electrically connected to said first input of said first AND gates and said one output of said first AND gate is electrically connected to said first sub-circuit of said driver circuit; and a second AND gate having a first input, a second input, and one output, wherein said second output of said flip-flop is electrically connected to said first input of said second AND gate, and said one output of said second AND gate is electrically connected to said second sub-circuit of said driver circuit; and wherein said clock input of said flip-flop, said second input of said first AND gate, and said second input of said second AND gate are electrically connected to receive the ignition signal pulse train.

18. The apparatus according to claim 17, wherein said J-K flip-flop has a reset input for receiving a pulse when the camshaft of an internal combustion engine reaches top dead center.

19. An apparatus for a distributorless ignition system which responds to an ignition signal pulse train of an internal combustion engine, said apparatus for use with a direct-current power supply having a positive terminal and a negative terminal, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

a driver circuit connected to said primary winding and having an activatable first sub-circuit and an activatable second sub-circuit, wherein said first sub-circuit is capable of electrically connecting said first end of said primary winding to the positive terminal of a direct-current power supply and also electrically connecting said second end of said primary winding to the negative terminal of the power supply, and said second sub-circuit is capable of electrically connecting said first end of said primary winding to the negative terminal of the power supply and also electrically connecting said second end of said primary winding to the positive terminal of the power supply; and a control circuit connected to said driver circuit for alternatingly activating said first sub-circuit and said second sub-circuit in response to an ignition signal pulse train, thereby directing electrical current through said primary winding in an opposite direction during each successive ignition signal pulse such that said spark plugs simultaneously fire after each ignition signal pulse.

20. An apparatus for a distributorless ignition system which responds to an ignition signal pulse train of an internal combustion engine, said apparatus for use with a direct-current power supply having a positive terminal and a negative terminal, said apparatus comprising:

at least one ignition coil having a primary winding, a secondary winding, and a core, wherein said primary winding and said secondary winding are wrapped about said core, and said primary winding has a first end and a second end;

a pair of spark plugs for each said ignition coil, wherein said spark plugs are connected between opposite ends of said secondary winding and electrical ground;

a driver circuit connected to said primary winding and having activatable first means for electrically connecting said first end of said primary winding to the positive terminal of a direct-current power supply and also electrically connecting said second end of said primary winding to the negative terminal of the power supply, and also having activatable second means for electrically connecting said first end of said primary winding to the negative terminal of the power supply and also electrically connecting said second end of said primary winding to the positive terminal of the power supply; and control means connected to said driver circuit for altematingly activating said first connecting means and said second connecting means in response to an ignition signal pulse train, thereby directing electrical current through said primary winding in an opposite direction during each successive ignition signal pulse such that said spark plugs simultaneously fire after each ignition signal pulse.

* * * * *

UNITED STATES PATENT AND TRADEMARK OFFICE

CERTIFICATE OF CORRECTION

PATENT NO. : 6,425,383 B1
DATED : July 30, 2002
INVENTOR(S) : Frank John Raeske et al.

It is certified that error appears in the above-identified patent and that said Letters Patent is hereby corrected as shown below:

Column 1,
Line 13, after “For” delete “modem” and insert therefor -- modern --.

Column 9,
Line 17, after “electrically” delete “connect ed” and insert therein -- connected --.

Column 13,
Line 5, after “providing an electrical” delete “connect ion bet ween” and insert therefor -- connection between --.
Line 13, after “winding and” delete “s aid” and insert therefor -- said --.

Signed and Sealed this

Fourth Day of February, 2003

JAMES E. ROGAN
*Director of the United States Patent and Trademark Office*